US009284506B2

(12) United States Patent
Meland et al.

(10) Patent No.: US 9,284,506 B2
(45) Date of Patent: Mar. 15, 2016

(54) STABILIZED WATER-IN-OIL EMULSIONS OF LIGHT OILS, AND METHODS AND APPARATUS/SYSTEM FOR THE PRODUCTIONS OF SUCH STABILIZED EMULSIONS

(75) Inventors: Arne Meland, Bergen (NO); Luigi Brambilla, Bremate (NO)

(73) Assignee: ECO ENERGY HOLDING AS, Bergen (NO)

( * ) Notice: Subject to any disclaimer, the term of this patent is extended or adjusted under 35 U.S.C. 154(b) by 244 days.

(21) Appl. No.: 13/635,416

(22) PCT Filed: Mar. 16, 2011

(86) PCT No.: PCT/NO2011/000084
§ 371 (c)(1),
(2), (4) Date: Apr. 29, 2013

(87) PCT Pub. No.: WO2011/115501
PCT Pub. Date: Sep. 22, 2011

(65) Prior Publication Data

US 2013/0205648 A1 Aug. 15, 2013

Related U.S. Application Data

(60) Provisional application No. 61/314,254, filed on Mar. 16, 2010.

(30) Foreign Application Priority Data

Mar. 16, 2010 (GB) ..... 1004382.6
Mar. 16, 2010 (NO) ..... 20100381

(51) Int. Cl.
*C10L 1/32* (2006.01)

(52) U.S. Cl.
CPC ..... *C10L 1/328* (2013.01)

(58) Field of Classification Search
CPC ..... C10L 1/328; C10L 1/32
USPC ..... 44/301
See application file for complete search history.

(56) References Cited

U.S. PATENT DOCUMENTS

2003/0134755 A1* 7/2003 Martin ..... 508/295

FOREIGN PATENT DOCUMENTS

EP 2116589 * 11/2009

* cited by examiner

*Primary Examiner* — Cephia D Toomer
*Assistant Examiner* — Chantel Graham
(74) *Attorney, Agent, or Firm* — Zareefa B. Flener; Flener IP Law

(57) ABSTRACT

A water-in-oil emulsion of light fuel oil, and a process for the stabilization of a water-in-oil emulsion of a light fuel oil are described.

48 Claims, No Drawings

STABILIZED WATER-IN-OIL EMULSIONS OF LIGHT OILS, AND METHODS AND APPARATUS/SYSTEM FOR THE PRODUCTIONS OF SUCH STABILIZED EMULSIONS

FIELD OF INVENTION

The present invention relates to a water-in-oil emulsion of a light fuel oil, and to a process for the stabilization of a water-in-oil emulsion of light fuel oil.

BACKGROUND OF THE INVENTION

The caloric value of fuel oils can be converted to mechanical energy or electric energy by means of combustion, and is generally used in boilers, turbines or engines. Many countries have set standards and regulations to control the maximum permissible discharge level of air pollutants to protect the environment. Thus, reducing the emitted concentration and amount of air pollutants, such as nitrogen oxides (NOx) and carbon oxides (COx), total hydrocarbons (THC), particulate matters (PM) and smoke as a result of fossil fuel combustion, is an important subject in environmental protection today.

To overcome the problems described above, some methods have been developed to form emulsion fuel oils by mixing fuel oil, water and preferable a specific additive.

Emulsification of water and light combustible oils improves the combustion efficiency in the combustion process which resulting in reduced harmful emission of air pollutants and reduced specific oil consumption, without creating undesirable side effects such as secondary emissions or hazardous waste.

In order to improve the lubrication effect of the emulsion and to strengthen the bindings between oil and water for the creation of emulsions with high stability and long storage ability, an emulsifying additive may be added in the emulsification process.

However, the emulsion fuel oils made from light oils and water formed with processes known from the prior arts has disadvantages of instability after long time storage. The resulting emulsion fuel oil is not very stable, and the water and oil are readily separated from each other. Most of the emulsions of light fuel oils can only maintain its emulsifying stability for a few days at room temperature. Thus, the emulsion fuel oil is usually used immediately as it is formed, and is unfavorable for large-scale production and long-distance transportation.

Further, it is sometimes preferable to prepare an emulsion without the addition of an emulsifying additive, and these emulsions are even more unstable, often less than 1 hour.

U.S. Pat. No. 4,394,131 describes a stable combustion fuel emulsion of a petroleum fuel having a small percentage of water dispersed therein as droplets of a size of about 0.5 micron. The experimental section of this patent discloses that stable (more than three month) emulsions have been obtained for residual oils with a viscosity of 400 SSU (example 1) and 4000 SSU (example 2). The most stable emulsions in example 1 and 2 have Water Droplets Size of 0.5 micron, and these emulsions are formed by a rotary impact mill operating at a speed of 1650 rpm.

In contrast, the object of the present invention is to provide stable emulsions of light oils, i.e. oils with a viscosity below 2 $mm^2/s$ at 40° C. The methods and the emulsions disclosed in U.S. Pat. No. 4,394,131 are not capable of providing stable emulsions of light oil and water.

The inventors of the present invention have surprisingly found that the stability of water in fuel oil emulsions of light oils, without or with added emulsifying additive, can be improved even further by reducing the particle size distribution and the mean size of the particles dramatically, i.e. to a mean size of about 0.2 micron (200 nm). Therefore, the present invention provides improved emulsion of light fuel oils, without emulsifying additive, to overcome the instability problems described above.

Further, the inventors have also found that the stability of water in light fuel oil emulsions with an emulsifying additive can be improved by reducing the particle size distribution and the mean size of the particles. Therefore, the present invention provides an improved emulsion light fuel oil with emulsifying additive, with an increased stability.

DETAILED DESCRIPTION OF THE INVENTION

It is an object of the present invention to provide a stable water-in-oil emulsion of a light fuel oil. It is an object of the present invention to provide an emulsion light fuel that can be stored for a long period of time without separation of the fuel oil and the water.

It is a further object of the present invention to provide a water-in-oil emulsion light fuel oil with improved stability, and a method for the preparation of such a stabilized emulsion. The increased stability is obtained irrespective of the addition of further additives.

It is a further object of the present invention to provide a water-in-oil emulsion light fuel oil with or without added emulsifying agent with improved stability, and a method for the preparation of such a stabilized emulsion.

It is a further object of the present invention to form emulsions with reduced particle size distribution, or reduced mean size of particles.

It is further object of the invention to reduce or eliminate the requirement for emulsifying additives, although the present invention can be combined with the addition of emulsifying additives.

It is a further object that the stabilized water in light fuel oil emulsion can be manufactured in a continuous in-line production process.

In order to obtain such stabilized water in fuel oil emulsions we established a test program to obtain knowledge and to document the effect of the various steps in the emulsification process and the effect of the emulsifier in the water in fuel oil emulsion.

Light oils in this patent application means the common notion of fuel oils from specific fractional distillate of petroleum fuel oil known as diesel, and also includes alternatives that are not derived from petroleum such as synthetic oils, vegetable oils, biodiesels, biomass to liquid (BTL) or gas to liquid (GTL) and other combustible oils. Preferable, the oils have a density below 930 $kg/m^3$ at 15° C.

In the experiments described below, we have used a light diesel oil (autodiesel) with a density of 840 $kg/m^3$ at 15° C. as a representative light oil. The viscosity of this oil is 2.2 $mm^2/s$ at 40° C. (and 0.1% sulphur). The chain lengths of the molecules are in the area of 9 to 16.

In contrast, the oil with the lowest density in the U.S. Pat. No. 4,394,131 is the marine residual fuel that has a density of 977 $kg/m^3$ at 15° C., and a viscosity of 45 $mm^2/s$ at 50° C. (with 0.5% sulphur), and the chain length of the molecules is in the area 12-70.

In a first aspect the present invention relates to a water-in-oil emulsion light fuel oil, comprising an amount of light fuel oil in the range of 50-95% and water in the range of 5-50% based on volumes, wherein the mean particle size distribution peak of the water particles is about 200 nm or less.

Preferable, the density of the light fuel oil is of 930 kg/m$^3$ or less at 15° C., more preferable below of 900 kg/m$^3$, or more preferable below 850 kg/m$^3$ such as about 840 kg/m$^3$ at 15° C.

Preferable, the viscosity of the light oil is below 6.0 mm$^2$/s, more preferable below 4.0 mm$^2$/s, and more preferable below 3.0 mm$^2$/s, and more preferable about 2.2 mm$^2$/s at 40° C.

Preferable, the amount of water in the emulsion is in the range of 15-40%, more preferable 18-30%, based on volumes, and more preferable about 20%.

In an alternative embodiment, said emulsion also comprises one or more emulsifying agents.

Preferable, said emulsifying agents are based on sorbitan, and preferable the said emulsifier consist of 67% of Sorbitan Monolate, preferable CAS N° 1338-43-8 and 33% Sorbitan Triolate 20 OE, preferable CAS N° 26266-58-0.

Preferable, the emulsion of the invention, is stable for at least 30 minutes, more preferable at least 60 minutes, more preferable at least 90 minutes, and more preferable at least 120 minutes, without any addition of emulsifier.

Preferable, the emulsion of the invention, is stable for at least 1 month, more preferable at least 2 months, more preferable at least 3 months, more preferable at least 4 months, more preferable at least 5 months, and most preferable at least 6 months if emulsifying agent(s) has/have been added A second aspect of the invention relates to a process for the stabilization of a water-in-oil emulsion of a light fuel oil, wherein an emulsion light fuel oil is prepared by dispersing and emulsifying (pre-mixing) in a light oil an amount of water in order to prepare an emulsion of water particles in the oil phase, characterized in that the particle size of the water particles in said emulsion are reduced in a particle size reducing step in order to stabilize said emulsion.

The preferred embodiment is by atomization, i.e. a liquid atomization where the particle sizes are reduced in said liquid.

Preferable, the particle size distribution peak of the water particles is about 200 nm or less after treatment with the process in accordance with the invention.

Preferable, the amount of water in the emulsion is in the range of 15-40%, more preferable 18-30%, based on volumes, preferable about 20%.

Alternatively, the emulsion comprises one or more emulsifying agents, preferable based on sorbitan, and preferable said emulsifying agents are based on sorbitan, and preferable the said emulsifier consist of 67% of Sorbitan Monolate, preferable CAS N° 1338-43-8 and 33% Sorbitan Triolate 20 OE, preferable CAS N° 26266-58-0.

Preferable, the mean particle size is reduced by at least 20%, more preferable by at least 30%, more preferable by at least 40%, and most preferable with about 50%.

Preferable, the number of particles/droplets are increased by at least 50 times, more preferable 70 times, more preferable 80 times, more preferable 90 times, and more preferable by at least two orders of magnitude.

Preferable, the mean particle size is reduced by at least 20%, more preferable by at least 30%, more preferable by at least 40%, and most preferable with about 50%, and the number of particles/droplets are increased by at least 50 times, more preferable 70 times, more preferable 80 times, more preferable 90 times, and more preferable by at least two orders of magnitude.

Preferable, the particle-size reducing step is conducted by a 2-stage homogenizer, preferable with parameters as follows;

inlet pressure of about 3 to 6 barg, preferable 4 barg;

1$^{st}$ stage pressure is between 30 and 100 barg, preferable 50 barg;

2$^{nd}$ stage pressure is between 50-250 barg, preferable 70 barg.

Preferable, the particle-size reducing step is conducted by a multi-stage dispersing generator, preferable with parameters as follows:

feed pressure of about 0.5 to 5 barg, preferable 1 barg speed of the dispersing generator is from 8 000 to 12 000 rpm, preferable about 12.000 rpm.

Preferable (wherein no emulsifying agent has been added), the emulsion is stable for at least 30 minutes, more preferable at least 60 minutes, more preferable at least 90 minutes, and more preferable at least 120 minutes.

Preferable, (wherein emulsifying agent(s) has/have been added), the emulsion is stable for at least 1 month, more preferable at least 2 months, more preferable at least 3 months, more preferable at least 4 months, more preferable at least 5 months, and most preferable at least 6 months.

Preferable, the density of the light fuel oil is of 930 kg/m$^3$ or less at 15° C., more preferable below of 900 kg/m$^3$, or more preferable below 850 kg/m$^3$ such as about 840 kg/m$^3$ at 15° C.

Preferable, the viscosity of the light oil is below 6.0 mm$^2$/s, more preferable below 4.0 mm$^2$/s, and more preferable below 3.0 mm$^2$/s, and more preferable about 2.2 mm$^2$/s at 40° C.

EXPERIMENTAL SECTION

The process for emulsifying water and light combustible oils contains a primary mixing step. The raw materials are fed simultaneously under controlled flow, pressure and temperature conditions into a common pipeline.

Typical mixing ratios of liquids are within the following ranges:

Combustible oil: 50-95% by volume

Water: 5-50% by volume

Emulsifier: 0-5% by volume

The volumes are controlled by means of flow control devises.

The inlet pressure of the raw materials is typically 15-25 barg enabling an accurate and steady flow of all the raw materials. The inlet pressure is depending on the required feed pressure to the premixing process that again is depending on the characteristics of the basic oil and the type of static mixing devices.

The inlet temperatures are depending on the characteristics of the basic oil and the emulsifier (if any), however, the temperatures should preferably be held on an evenly level below 50° C.

The above described process step prepares a mixture of the components of the emulsion (i.e. a "premix"), and each of the components (water and oil, and optionally emulsifier) are evenly distributed in the emulsion solution. This emulsion is not stable, and is especially unstable if emulsifiers are omitted. Such an emulsion is used as a control sample in the experiments described in the examples below, and is in the table 1 termed "premix".

In some of the experimental tests we have included an emulsifier (or a mixture of emulsifying agents) (se for instance the samples 2a, 3a, 4a and 5a in table 1). The addition of emulsifier increases the stability of the emulsion, but also such emulsions are further stabilized with the process according to the invention, i.e. by a reduction of the size of the particles.

The primary mixing process (i.e. "premix" process) described above is a process, preferable in line flow process, designed to create a mixture where the components are evenly distributed, i.e. where the mixture is not phase separated. The requirement for the premix is to remain stable and in one phase until the mixture has been fed into the second treatment step, i.e. the atomization process.

In the primary mixing process, the mixture of raw materials in a common pipeline or separate feed pipelines, is fed by means of the inlet pressure through a set of static mixing devises where the premixing process takes place. The pressure drop across the static mixing devises is predefined in accordance with the type of the mixing devices and the characteristics of the oils. A pressure control valve controls the process. Typical pressure drop is between 4 and 12 barg.

Example 1

Preparation of a Stabilized Water in Diesel Emulsion

The purpose of the test program was to establish knowledge and to document the effect of the various steps in the emulsification process and the effect of the emulsifier in so-called LiteWhiteDiesel (LWD). In view of the purpose, tests were made and samples for analysis drawn from the premixing step (described above) and a second homogenization or atomization process. The samples after this second homogenization or atomization treatment are termed "final product" and represent the product according to the invention.

This second homogenization or atomization treatment have been conducted both on emulsions with and without emulsifying agent(s).

Water (20% by volume) and diesel oil (80% by volume) were fed through a static mixer. The inlet pressure was 20 barg, and the temperature was about 15° C.

Normal commercial available auto diesel was used in the test. The colour of the diesel was yellow/brown due to 7% biodiesel by volume was mixed into the diesel. The paraffin content of the diesel is not known. Actual density of the diesel was 836.4 kg/m$^3$ at 20.3° C. and actual viscosity of the diesel was 2.2 mm$^2$/s at 40° C.

The "premix" emulsion (one phase and components evenly distributed, but not stable) is fed directly to a 2-stage homogenizer (FBF 2-stage homogenizer at 50/70 bar) with a feed pressure of about 4 barg. Set pressures of 1$^{st}$ and 2$^{nd}$ stage of the homogenizer were 50 barg and 70 barg, respectively. The homogenizer used for the atomizing process is a MICROLAB 1001/h available from FBF, Italy.

Depending on the nature of the premix composition, and optionally the choice and amount of emulsifier (if any), results obtained in other experiments have indicated that the feed pressure can be in the range of about 3 to 6 barg, and under many circumstance a pressure of about 4 barg will give good results. Further, the set pressures of 1$^{st}$ and 2$^{nd}$ stage of the homogenizer are also depending of the characteristic of the premix (defined by the characteristics of the basic oil) and the use of emulsifier and type of emulsifier. 1$^{st}$ stage pressure for various mixtures are typically between 30 and 100 barg, and 2$^{nd}$ stage pressure is typically between 50-250 barg.

By leaving the homogenizer the water in diesel emulsion is finished made (termed "final product"), and the stability of the emulsion has increased dramatically, and the emulsion can be transferred to a storage tank or fed directly to the application site.

Results

The emulsion according to the invention, i.e. example 1, was compared to the emulsion according to the prior art, i.e. after the premix step. The particle sizes of the water particles in the oil were measured, and this was correlated with the stability of the emulsion. The emulsion according to the invention has reduced particle size distribution and increases stability, compared with the prior known emulsion.

The emulsifier used in this test is based on sorbitan, and preferable the emulsifier consist of 67% of Sorbitan Monolate, preferable CAS N° 1338-43-8 and 33% Sorbitan Triolate 20 OE, preferable CAS N° 26266-58-0.

The size of the particles in the emulsion, the size distribution of particles, and number of particles, before and after the inventive treatment were measured by Filarete Servizi Srl, Milano, Italy. The microscope used was a Leica TCS SP5 AOBS confocal microscope and ImageJ freeware software for data analysis.

The stability of the emulsions were measured by visual inspection, conducted by Eco Energy. Further, centrifugal tests were also used, and the centrifuge used was a REMI R-8 CXS Bench Top Centrifuge in accordance with UNICHIM MU 1548. Centrifugal speed was 5 000 rpm, temperature 20° C. for 5 minutes.

Test Schedule

A total of 12 samples in accordance with table 1 below schedule were prepared and analyzed.

TABLE 1

| Sample no. Pure diesel | Diesel (I) | Water (I) | Emulsifier (I) | Sample point Diesel supply | Stability | Avg. size of droplets |
|---|---|---|---|---|---|---|
| 1a | 20.000 | 5.000 | 0.000 | Premix (control) | 3 minutes | 700 nm |
| 1b | 20.000 | 5.000 | 0.000 | Premix (control) | 5 minutes | 400 nm |
| 1c | 20.000 | 5.000 | 0.000 | Final product | 2 hours | 200 nm |
| 2a | 19.875 | 5.000 | 0.125 | Premix (control) | 7 days | 400 nm |
| 2b | 19.875 | 5.000 | 0.125 | Final product | 6-12 months | 200 nm |
| 3a | 19.750 | 5.000 | 0.250 | Premix (control | 9 days | 400 nm |
| 3b | 19.750 | 5.000 | 0.250 | Final product | 6-12 months | 200 nm |
| 4a | 19.625 | 5.000 | 0.375 | Premix (control) | 15 days | 400 nm |
| 4b | 19.625 | 5.000 | 0.375 | Final product | 6-12 months | 200 nm |
| 5a | 19.500 | 5.000 | 0.500 | Premix (control) | 15 days | 400 nm |
| 5b | 19.500 | 5.000 | 0.500 | Final product | 6-12 months | 200 nm |

The "premix" samples were prepared by a primary mixing step (as described above). Analysis revealed that 2 runs through a static mixer provided a "premix"-solution with sufficient homogeneity (i.e. one phase and the components evenly distributed in the mixture). We have to emphasis that all kinds of mixing equipments can be used, and that the mixing condition depends on the ingredients of the emulsion.

The samples have been prepared by placing a droplet of the emulsion on a microscope slide and looking at it from the bottom (through the glass).

Results

The samples without emulsifying agent, i.e. the samples 1a, 1b and 1c were so unstable that it was difficult to measure the particle sizes. However, the stability of the particles increased tremendously by the process according to the invention, from about a stability of only a few minutes for the "premix" samples to a stability of several hours for the "final product" samples (i.e. the emulsions according to the invention).

The samples indicated as 2a, 3a, 4a and 5a are "premix" samples with an addition of various amounts of emulsifier. The addition of emulsifier represent an improvement of the stability, and this effect is well known in the prior art. These samples function as control samples for the treated samples 2b, 3b, 4b and 5b. The samples 2b, 3b, 4b and 5b are prepared by treating the control samples 2a, 3a, 4a and 5a, respectively, with a secondary homogenization treatment (as described above) in order to reduce the sizes of particles in the emulsion.

The control samples, i.e. the premix samples are composed of particles (droplets) with a size distribution peak at about 400 nm. In contrast, the samples termed "final product" have a size distribution peak that is smaller than 200 nm, i.e. smaller than the resolution limit of the instrument. The droplets of the "final product" samples are also more optimally packed, and the droplet distributions characteristics are more homogenous than the control samples (premix samples). The number of droplets in the "final product" seems to be at least two orders of magnitude higher than the number in the control samples (premix).

The particle size of the control sample (termed premix) is even smaller than the particle size of the stable emulsions of the more viscous residual oil disclosed in U.S. Pat. No. 4,394,131. This implies that the stability of an emulsion is reduced from about 3 months for viscous oils (about 45 $mm^2/s$ at 50° C.) with a particle size of 500 nm to about 2-3 minutes for light oils (viscosity of about 2.2 $mm^2/s$ at 40° C.) with a particle size of about 400 nm.

DEFINITIONS OF TERMS USED IN THE APPLICATION

Barg: Bar gage

Premix: An even mixture of components, i.e. water and oil evenly distributed throughout the solution in one phase.

Atomization: A process where the sizes of the particles in a solution (emulsion) are reduced. In this specific context the atomization relates to process in a solution (emulsion), and more preferable to a water-in-oil emulsion where the water droplets or particles are reduced.

Light oil: In the present application, the term "light oil" or "light fuel oil" defines an oil with a density of 930 $kg/m^3$ at 15° C., or less. A representative example of such a light oil is "light diesel" (autodiesel) with a density of 840 $kg/m^3$ at 15° C. The viscosity of this oil is 2.2 $mm^2/s$ at 40° C. (and 0.1% sulphur). The chain length of the molecules is in the area 9 to 16.

Heavy oil: In the present application, the term "heavy oil" or "heavy fuel oil" defines an oil with a density of more than 930 $kg/m^3$ at 15° C. A representative example of such an oil is "marine residual fuel oil" which has a density of 977 $kg/m^3$ at 15° C., and a viscosity of 45 $mm^2$/at $kg/m^3$ at 50° C. (with 0.5% sulphur), and the chain length of the molecules is in the area 12 to 70.

Particle size distribution: Is a list of values that defines the relative amounts of particles present, sorted according to size Particle size distribution peak: Is the size of the majority of the relative amount of particles present

The invention claimed is:

1. A water-in-oil emulsion of light fuel oil, comprising an amount of light fuel oil in the range of 50-95% and water in the range of 5-50% based on volumes, wherein the emulsion is stable at ambient pressure, and the mean particle size distribution peak of the water particles is 200 nm or less, and wherein the density of the light fuel oil is of 930 $kg/m^3$ or less at 15° C.

2. The water-in-oil emulsion of claim 1, wherein the viscosity of the light oil is below 6.0 $mm^2/s$ at 40° C.

3. The water-in-oil emulsion of claim 1, wherein the amount of water in the emulsion is in the range of 15-40%, based on volume.

4. The water-in-oil emulsion of claim 1, wherein said emulsion also comprises one or more emulsifying agents.

5. The water-in-oil emulsion of claim 4, wherein said emulsifying agents consists of 67% Sorbitan Monolate, CAS N° 1338-43-8 and 33% Sorbitan Triolate 20 OE, CAS N° 26266-58-0.

6. A water-in-oil emulsion in accordance with claim 1, wherein the emulsion fuel oil is prepared by dispersing and emulsifying in an oil an amount of water in order to prepare a homogenous emulsion of water particle in the oil phase, characterized in that the particle size of the water particles are reduced in a particle size reducing step in order to stabilize said emulsion.

7. The water-in-oil emulsion in accordance with claim 6, wherein the mean particle size is reduced by at least 20%.

8. The water-in-oil emulsion in accordance with claim 6, wherein the number of particles/droplets are increased by at least 50 times.

9. The water-in-oil emulsion in accordance with claim 6, wherein the particle-size reducing step is conducted by a 2-stage homogenizer.

10. The water-in-oil emulsion in accordance with claim 9, wherein parameters of the 2-stage homogenizer are as follows:

inlet pressure of about 3 to 6 barg;

1st stage pressure is between 30 and 100 barg;

2nd stage pressure is between 50-250 barg.

11. The water-in-oil emulsion in accordance with claim 6, wherein the particle size reducing step is conducted by a multi-stage dispersing generator.

12. The water-in-oil emulsion in accordance with claim 11, wherein parameters of the multi-stage dispersing generator are as follows:

feed pressure of about 0.5 to 5 barg; and speed of the dispersing generator is from 8 000 to 12 000 rpm.

13. The water-in-oil emulsion in accordance with claim 1, wherein no emulsifying agent has been added, wherein the emulsion is stable for at least 30 minutes.

14. The water-in-oil emulsion in accordance with claim 1, wherein emulsifying agent(s) has/have been added, wherein the emulsion is stable for at least 1 month.

15. The water-in-oil emulsion of claim 2, wherein the viscosity of the light oil is below 4.0 $mm^2/s$.

16. The water-in-oil emulsion of claim 2, wherein the viscosity of the light oil is below 3.0 $mm^2/s$.

17. The water-in-oil emulsion of claim 2, wherein the viscosity of the light oil is about 2.2 $mm^2/s$ at 40° C.

18. The water-in-oil emulsion of claim 3, wherein the amount of water in the emulsion is in the range of 18-30% based on volumes.

19. The water-in-oil emulsion of claim 3, wherein the amount of water in the emulsion is about 20%.

20. The water-in-oil emulsion of claim 1, wherein the density of the light fuel oil is below 900 kg/m$^3$ at 15° C.

21. The water-in-oil emulsion of claim 1, wherein the density of the light fuel oil is below 850 kg/m$^3$ at 15° C.

22. The water-in-oil emulsion of claim 1, wherein the density of the light fuel oil is about 840 kg/m$^3$ at 15° C.

23. The water-in-oil emulsion of claim 4, wherein said emulsifying agents comprise sorbitan.

24. The water-in-oil emulsion in accordance with claim 7, wherein the mean particle size is reduced by at least 30%.

25. The water-in-oil emulsion in accordance with claim 7, wherein the mean particle size is reduced by at least 40%.

26. The water-in-oil emulsion in accordance with claim 7, wherein the mean particle size is reduced by about 50%.

27. The water-in-oil emulsion in accordance with claim 8, wherein the number of particles/droplets are increased by at least 70 times.

28. The water-in-oil emulsion in accordance with claim 8, wherein the number of particles/droplets are increased by at least 80 times.

29. The water-in-oil emulsion in accordance with claim 8, wherein the number of particles/droplets are increased by at least 90 times.

30. The water-in-oil emulsion in accordance with claim 8, wherein the number of particles/droplets are increased by at least two orders of magnitude.

31. The water-in-oil emulsion in accordance with claim 10, wherein parameters of the 2-stage homogenizer are as follows:

inlet pressure of between about 3 to 6 barg;
1st stage pressure is about 50 barg;
2nd stage pressure is between about 50-250 barg.

32. The water-in-oil emulsion in accordance with claim 10, wherein parameters of the 2-stage homogenizer are as follows:

inlet pressure of between about 3 to 6 barg;
1st stage pressure is between about 30 and 100 barg;
2nd stage pressure is about 70 barg.

33. The water-in-oil emulsion in accordance with claim 10, wherein parameters of the 2-stage homogenizer are as follows:

inlet pressure of about 4 barg;
1st stage pressure is between about 30-100 barg;
2nd stage pressure is between about 50-250 barg.

34. The water-in-oil emulsion in accordance with claim 10, wherein parameters of the 2-stage homogenizer are as follows:

inlet pressure of about 4 barg;
1st stage pressure is about 50 barg;
2nd stage pressure is between about 50-250 barg.

35. The water-in-oil emulsion in accordance with claim 10, wherein parameters of the 2-stage homogenizer are as follows:

inlet pressure of about 4 barg;
1st stage pressure is between about 30 and 100 barg;
2nd stage pressure is about 70 barg.

36. The water-in-oil emulsion in accordance with claim 10, wherein parameters of the 2-stage homogenizer are as follows:

inlet pressure of about 4 barg;
1st stage pressure is between about 30 and 100 barg;
2nd stage pressure is between about 50-250 barg.

37. The water-in-oil emulsion in accordance with claim 10, wherein parameters of the 2-stage homogenizer are as follows:

inlet pressure of about 4 barg;
1st stage pressure is about 50 barg;
2nd stage pressure is about 70 barg.

38. The water-in-oil emulsion in accordance with claim 12, wherein parameters of the multi-stage dispersing generator are as follows:

feed pressure of about 1 barg; and
speed of the dispersing generator is from 8 000 to 12 000 rpm.

39. The water-in-oil emulsion in accordance with claim 12, wherein parameters of the multi-stage dispersing generator are as follows:

feed pressure of about 0.5 to 5 barg; and
speed of the dispersing generator is about 12.000 rpm.

40. The water-in-oil emulsion in accordance with claim 12, wherein parameters of the multi-stage dispersing generator are as follows:

feed pressure of about 1 barg; and
speed of the dispersing generator is about 12.000 rpm.

41. The water-in-oil emulsion in accordance with claim 13, wherein no emulsifying agent has been added, wherein the emulsion is stable for at least 60 minutes.

42. The water-in-oil emulsion in accordance with claim 13, wherein no emulsifying agent has been added, wherein the emulsion is stable for at least 90 minutes.

43. The water-in-oil emulsion in accordance with claim 13, wherein no emulsifying agent has been added, wherein the emulsion is stable for at least 120 minutes.

44. The water-in-oil emulsion in accordance with claim 14, wherein emulsifying agent(s) has/have been added, wherein the emulsion is stable for at least 2 months.

45. The water-in-oil emulsion in accordance with claim 14, wherein emulsifying agent(s) has/have been added, wherein the emulsion is stable for at least 3 months.

46. The water-in-oil emulsion in accordance with claim 14, wherein emulsifying agent(s) has/have been added, wherein the emulsion is stable for at least 4 months.

47. The water-in-oil emulsion in accordance with claim 14, wherein emulsifying agent(s) has/have been added, wherein the emulsion is stable for at least 5 months.

48. The water-in-oil emulsion in accordance with claim 14, wherein emulsifying agent(s) has/have been added, wherein the emulsion is stable for at least 6 months.

* * * * *